United States Patent [19]

Cadars

[11] Patent Number: 4,576,227

[45] Date of Patent: Mar. 18, 1986

[54] HEAT EXCHANGER, IN PARTICULAR FOR A MOTOR VEHICLE, AND SIDE SEALING DEVICE THEREFOR

[75] Inventor: Patrick Cadars, Montigny, France

[73] Assignee: Valeo, Paris, France

[21] Appl. No.: 504,144

[22] Filed: Jun. 14, 1983

[30] Foreign Application Priority Data

Jun. 29, 1982 [FR] France ..... 82 11419

[51] Int. Cl.[4] ..... F28D 1/00; F28F 9/02

[52] U.S. Cl. ..... 165/149; 165/76

[58] Field of Search ..... 165/149, 76

[56] References Cited

U.S. PATENT DOCUMENTS

| | | | |
|---|---|---|---|
| 1,477,845 | 12/1923 | O'Brien | 165/149 |
| 2,168,549 | 8/1939 | Young | 165/182 |
| 2,205,984 | 6/1940 | Kromas | 165/149 |
| 3,263,746 | 8/1966 | Becher et al. | 165/67 |

FOREIGN PATENT DOCUMENTS

| | | | |
|---|---|---|---|
| 2522401 | 9/1983 | France | 165/149 |
| 1437251 | 8/1972 | United Kingdom | 165/149 |
| 1486805 | 9/1977 | United Kingdom | 165/149 |
| 1484510 | 9/1977 | United Kingdom | 165/149 |

*Primary Examiner*—William R. Cline
*Assistant Examiner*—John K. Ford
*Attorney, Agent, or Firm*—Dennison, Meserole, Pollack & Scheiner

[57] ABSTRACT

A side sealing device comprises a plate (22) which covers one side (18) of the tube bundle constituting the heat exchanger. It is snap-fitted to the bundle by suitable end tabs (32) for engaging the ends of the tubes of like projections. The invention is particularly applicable to heat exchangers for motor vehicles.

8 Claims, 7 Drawing Figures

10
12
14
16
18
20
22
22'
24
26
28
30
32
32'

HEAT EXCHANGER, IN PARTICULAR FOR A MOTOR VEHICLE, AND SIDE SEALING DEVICE THEREFOR

The present invention relates to a device for sealing the side of a heat exchanger comprising a bundle of finned tubes or the like, and in particular to a heat exchanger for use in a motor vehicle.

BACKGROUND OF THE INVENTION

A primary fluid (which may be hot or cold depending on circumstances) passes through the tubes in a heat exchanger bundle, and serves to heat or to cool a secondary fluid, such as air, which crosses through the bundle.

Sometimes the heat exchanger is mounted in a housing which includes a conduit for circulating and guiding the secondary or external fluid. Since the heat exchanger bundle is generally substantially in the shape of a parallelipiped, the secondary fluid crosses through the bundle by entering one of the large faces of the parallelipiped and by leaving through the opposite large face, thereby passing over the fins or other heat exchange surfaces which are provided on the tubes and which extend parallel to the direction of flow of the secondary fluid.

In order for the heat exchanger to have acceptable efficiency, it is important to prevent the secondary fluid from flowing round the bundle rather than through it. For this purpose, proposals have already been made to close the lateral faces of the bundle, i.e. the faces extending perpendicularly to the large faces through which the secondary fluid flows, by various suitable means, such as by having ribs on the sides of the housing for co-operating with said side faces of the bundle, or by pressing or gluing sealing means to said side faces, etc.

Some of the known means are not very effective, while others are expensive, or else, once fixed on the side faces of the bundle, they hinder its insertion and assembly in said housing.

Preferred embodiments of the present invention provide a simple, effective and cheap solution to the above problem of sealing the sides of a heat exchanger bundle.

SUMMARY OF THE INVENTION

The present invention provides a side sealing device for a heat exchanger, in particular of the type intended for use in a motor vehicle and comprising a bundle of tubes fitted with fins, said bundle having first and second large faces for inlet and outlet of of an external heat exchanger fluid and two opposite side faces lying parallel to the general direction of the tubes in the bundle, the improvement wherein the side sealing device comprises a plate substantially in the shape of an elongate rectangle having resilient snap-fitting means at at least one of its ends for snap-fitting to at least one heat exchanger tube or the like, said plate being intended to be fitted over one of said side faces of the bundle.

Thus, in order to obtain good side sealing for a heat exchanger bundle in accordance with the invention, it suffices to apply a rectangular plate to each of said side surfaces and to snap fit its ends to parts of the heat exchanger such as the tubes in the bundle. Such a plate can be made very cheaply by molding or cutting out from a single piece of plastic material.

The snap-fitting means may comprise tabs suitable for pivoting about a line perpendicular to the long direction of the plate, said tabs having curved longitudinal sides and/or sideways projecting points suitable for snap-fitting resiliently to heat exchanger elements.

The invention also provides a heat exchanger of the type described above with at least one of said opposite side faces of the bundle extending parallel to the general direction of the tubes in the bundle being covered by said side sealing plate which is snap fitted at at least one of its ends to elements of the heat exchanger.

The elements in question may be the tubes of the bundle or they may be lugs provided specially for the purpose on water boxes located at the, or each, end of the tubes in the bundle.

BRIEF DESCRIPTION OF THE DRAWINGS

An embodiment of the invention is described by way of example with reference to the accompanying drawings, in which.

MORE DETAILED DESCRIPTION

Figures 1, 2, 3:
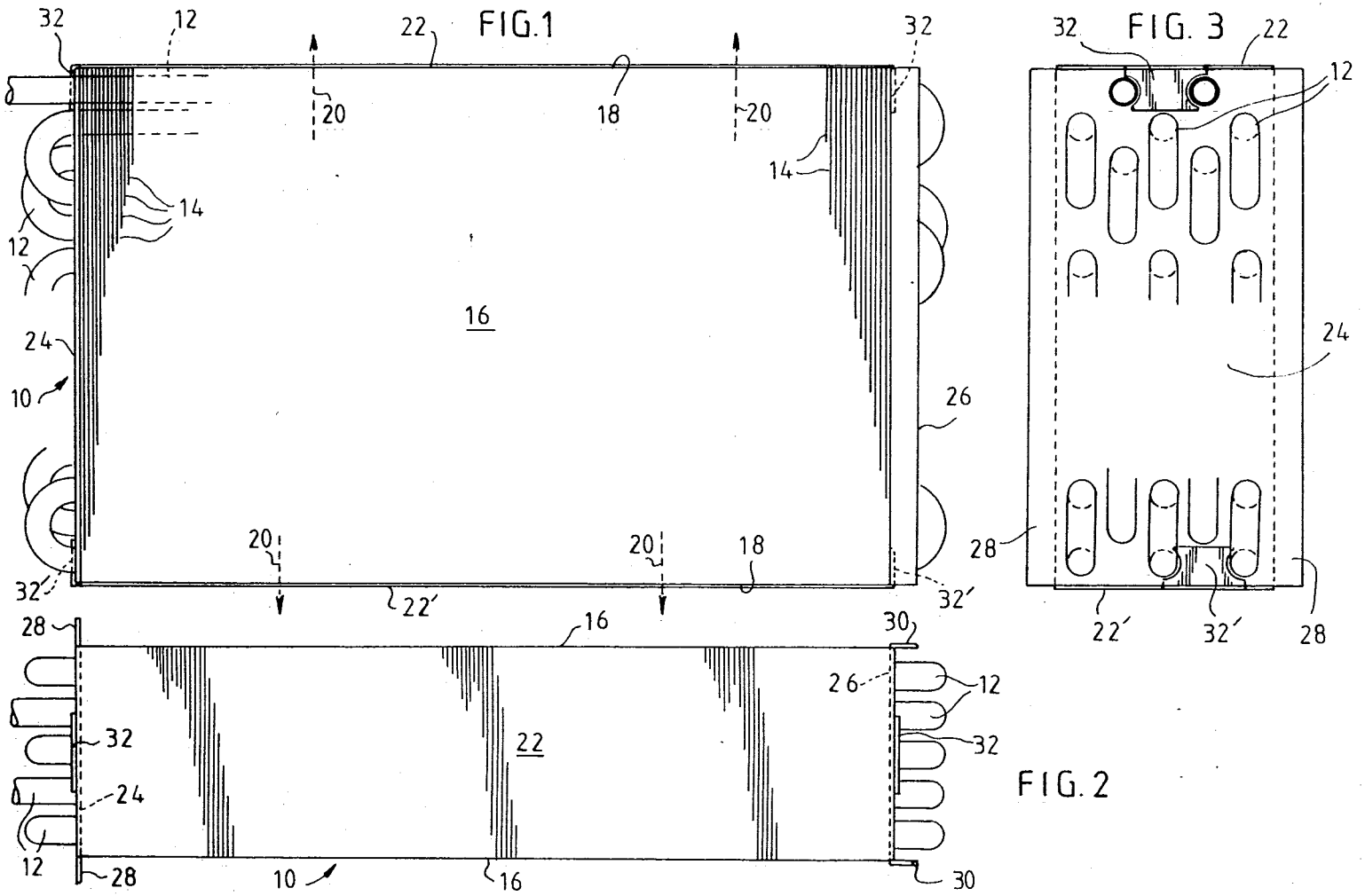
FIG. 1 is a front view of a heat exchanger fitted with a lateral sealing device in accordance with the invention.
FIG. 2 is a top view of the heat exchanger.
FIG. 3 is a view of the heat exchanger's left hand side.

The heat exchanger shown in FIGS. 1 to 3 comprises a bundle 10 of tubes. In operation, a primary heat exchange fluid (for heating or for cooling) flows along the tubes.

The bundle 10 may comprise a single tube 12 having 180° U-bends at each end of the bundle, as shown in the drawings, or else it may comprise a series of parallel tubes which are connected to one another at the ends of the bundle by any suitable means, eg. by water boxes or the like. In either arrangement, the heat exchanging portion of the bundle comprises a bundle of parallel tubes or tube portions, which for simplicity of language are referred to as tubes, even if they are, in fact, different portions of the same tube. The tubes of the bundle are provided with means for exchanging heat with a secondary or external fluid crossing through the bundle between the tubes. These means may comprise plane parallel fins 14 which are fixed to the tubes and which extend at right angles to the general direction of the tubes in the bundle. The exterior sides of the fins determine the general outside shape of the bundle, and when the fins are rectangular, the resulting bundle is in the shape of a rectangular parallelipiped.

As mentioned above, the bundle is intended to have a secondary or external fluid, eg. air, crossing through it, said fluid arriving or being guided perpendicularly to one of the large faces 16 of the bundle, then passing through the bundle by flowing parallel to the fins 14 and finally leaving the bundle via its opposite large face 16.

In order for the secondary fluid to be correctly heated or cooled as the case may be, it is necessary for it to cross through the bundle without going round it and without leaving it early along dotted arrows 20 through the sides 18 of the bundle which extend generally parallel to the tubes and at right angles to the large faces 16.

In accordance with the invention, these sides 18 are covered by plates 22 which constitute lateral sealing devices. The plates 22 are the same size as the side faces 18 which they cover, and they are fixed thereto by snap-fitting their ends to the ends of the bundle 10. Thus, the secondary fluid crossing through the bundle can no longer escape from the bundle via the side faces 18.

The other pair of faces of the bundle 10, ie. the side faces which are at right angles both to the above-mentioned side faces 18 and to the large face 16, are closed by conventional rectangular perforated plates 24 and 26 to which plates the ends of the tubes 12 are sealed. The perforated plates 24 and 26 may have respective projecting rims 28 and 30 which may extend in the plane of the perforated plate or at right angles thereto. Such rims serve to co-operate with portions of a bundle-receiving housing (not shown) to prevent the secondary fluid from getting round the outside of the bundle. Likewise, the side sealing plates 22 may also co-operate with portions of said housing to prevent the secondary fluid getting round the bundle past its side faces 18.

Figure 4:
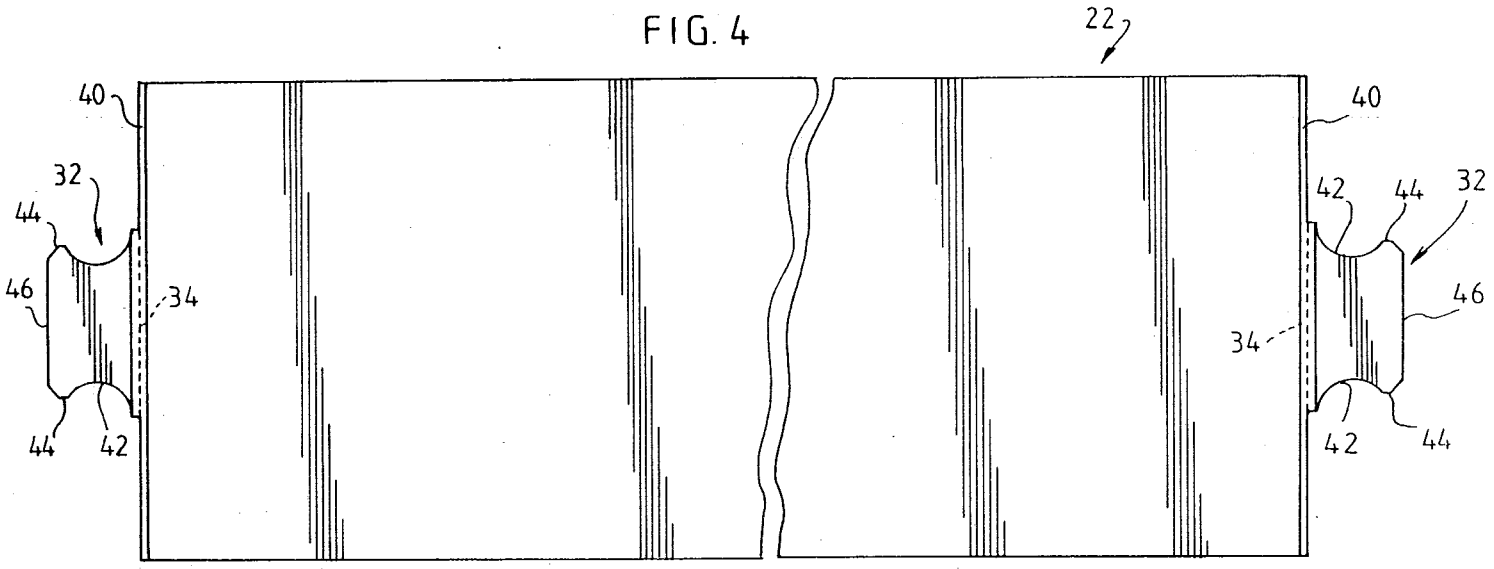
FIG. 4 is a plan view of a lateral sealing device in accordance with the invention.
Figure 5:
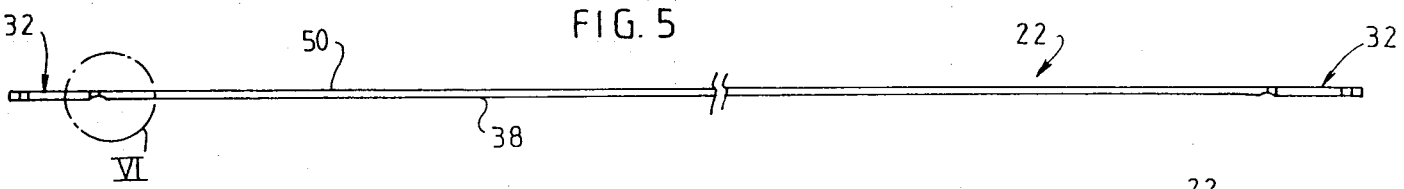
FIG. 5 is an elevation of the device.
Figure 6:
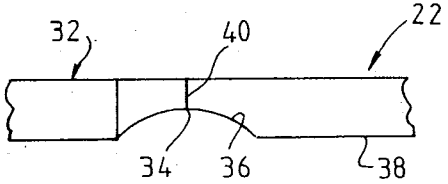
FIG. 6 is a view on an enlarged scale of a detail VI of FIG. 5.

Reference is now made to FIGS. 4 to 6, which show in more detail, one embodiment of a plate 22 in accordance with the invention.

Each plate 22 is substantially in the shape of an elongate rectangle having snap-fitting means at its ends. In the example shown, the snap-fitting means comprise tabs 32 which normally extend in the plane of the plate 22, but which may be made to extend perpendicularly to the plate by folding or by pivoting about a transversal line 34. The plate 22 is a very thin and relatively rigid plate obtained in a single piece with the tabs 32 by moulding or by cutting out using a plastic material such as polypropylene. The fold lines 34 are realised in the form of thin flexible hinges by pressing the plate in a press to obtain a transverse groove of circular profile 36 in the bottom face 38 of the plate 22 towards which the tabs are to be folded. The particular shapes of the tabs 32 may then be obtained by cutting out, in such a manner that the lines 34 along the middles of the grooves 36 are aligned with the ends 40 of the plate 22 to which the tabs are connected.

The plane tabs 32 have concave ends 42 in the form of arcs of circles leading via points 44 to extreme end edges 46 of the plate 22.

In the embodiment shown, the tabs 32 are intended to co-operate with the ends of the tubes 12 of the bundle, the concave ends 42 being curved to match the curvature of the outsides of the tubes, as shown in FIG. 3.

Thus the plate 22 is simply placed on one of the side faces 18 of the bundle it is intended to cover, and the tabs 32 are pressed down to snap into engagement between two adjacent tube ends projecting from the bundle.

The plates 22 protect the ends of the fins 14 and facilitate insertion of the heat exchanger into its housing by peventing the edges of the ends of the fins from snagging or deforming on contact with the wall of the housing.

If the heat exchanger has water boxes at the ends of the bundle fixed to the perforated plates 24 and 26, the side sealing plates may be mounted on the side faces 18 of the bundle before the perforated plates 24 and 26 are mounted so that the tabs 32 engage the ends of the tubes in between the end fins 14 and the perforated plates themselves.

In the example shown in FIGS. 4 to 6, the end tabs 32 are provided substantially in the middles of the ends of the plate 22 so that the plate may be mounted on the bundle in the manner shown at the top of FIG. 3. The bottom of FIG. 3 shows an alternative arrangement in which a plate 22' has a tabs 32' which is off set to one side. The exact arrangement adopted will depend on the disposition of the tubes with which the tabs are to come into engagement.

In a variant, not shown, the top face 50 of the plate 22 may have ribs moulded thereon for co-operating with the sides of the housing in which the heat exchanger is mounted.

Figure 7:
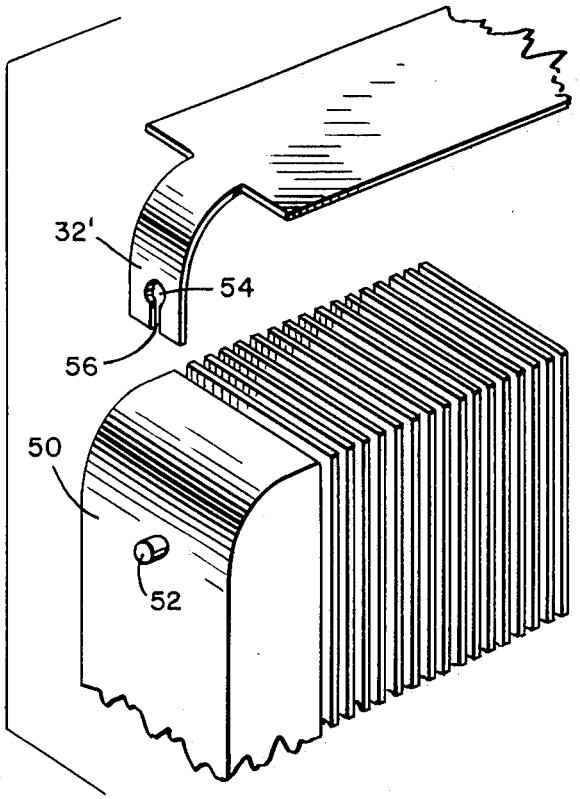
FIG. 7 is a perspective detail view of a variation in accordance with the invention.

In another variant, shown in FIG. 7, when the heat exchanger has water boxes 50 (one shown) at its ends, the water boxes 50 may be fitted with projecting lugs 52 to which the sealing plate end tabs 32' may be snap fitted.

The fitting may be between a pair of lugs, in which case the tabs will remain unchanged in shape, or alternatively, the water boxes may have single lugs 52 for receiving the tabs 32', in which case the tabs will need to be fitted with a single lug-receiving hole 54 with a radial slot 56.

What is claimed is:

1. A side sealing device for a heat exchanger, in particular of the type intended for use in a motor vehicle and comprising a bundle of tubes fitted with fins, the tubes in the bundle having opposed ends, said bundle having first and second large faces for inlet and outlet of an external heat exchanger fluid and two opposite side faces lying parallel to the general direction of the tubes in the bundle, the improvement wherein the side sealing device comprises a plate substantially in the shape of an elongate rectangle having a longitudinal extent and opposed ends, and resilient snap-fitting means on said plate opposed ends for snap-fitting engagement with the tubes on the heat exchanger, said snap-fitting means comprising pivoted tabs at the opposed ends of the plate resiliently deformable to engage between the ends of the tubes in the bundle in a manner whereby the engaged snap-fitting means precludes movement of said sealing device relative to the heat exchanger independent of other means, said plate being engageable over one of said side faces of the bundle.

2. A device according to claim 1 wherein each said tab has laterally diverted projecting end portions suitable for snap-fitting resiliently to said tube ends.

3. A device according to claim 1, wherein said plate and said snap-fitting means are made from a single piece of plastic.

4. A device according to claim 3, wherein each tab is connected to said plate by a flexible hinge defined by a reduced thickness of material along a line perpendicular to the longitudinal direction of the plate and between the plate and the corresponding tab.

5. A heat exchanger according to claim 1, wherein said side sealing plate is of identical shape and size to said side face over which it is engaged.

6. A device according to claim 1 wherein said fins have exterior sides which determine the general outside shape of the bundle, said plate, when engageable over one of said side faces, being substantially coextensive with the corresponding exterior side of said fins, said snap-fitting means snap-fitting to the tube ends beyond said corresponding exterior side of said fins.

7. A device according to claim 6 wherein the sealing device, when engageable over one of said side faces, is directly and solely supported by the heat exchanger.

8. A device according to claim 1, wherein each said tab has laterally directed projecting end portions suitable for snap-fitting resiliently to and between a pair of adjacent tube ends on said heat exchanger with the projecting end portions extending laterally of the pair of adjacent tube ends inward thereof relative to the plate to preclude movement of the side sealing device in any direction relative to the heat exchanger, and to support the side sealing device independent of other mounting structure.

* * * * *